US005744903A

United States Patent [19]

Van Der Poel et al.

[11] Patent Number: 5,744,903

[45] Date of Patent: Apr. 28, 1998

[54] COLOR CATHODE RAY TUBE WITH SUBELECTRODES

[75] Inventors: Willibrordus A.J.A. Van Der Poel; Antonius W.F. Van De Heijden, both of Eindhoven, Netherlands

[73] Assignee: U.S. Philips Corporation, New York, N.Y.

[21] Appl. No.: 635,339

[22] Filed: Apr. 19, 1996

[30] Foreign Application Priority Data

May 2, 1995 [EP] European Pat. Off. ..... 95201135

[51] Int. Cl.[6] ..... H01J 29/62

[52] U.S. Cl. ..... 313/414; 313/460; 315/14

[58] Field of Search ..... 313/414, 412, 313/460, 449; 315/14, 15

[56] References Cited

U.S. PATENT DOCUMENTS

| | | | |
|---|---|---|---|
| 4,626,738 | 12/1986 | Gerlach | 313/414 |
| 5,146,133 | 9/1992 | Shirai et al. | 313/414 |
| 5,347,202 | 9/1994 | Stil | 315/382 |
| 5,539,285 | 7/1996 | Iguchi et al. | 313/414 |

*Primary Examiner*—Michael Horabik
*Assistant Examiner*—Michael Day
*Attorney, Agent, or Firm*—Robert J. Kraus

[57] ABSTRACT

Color cathode ray tube (1) device having an electron gun (6) of the in-line type for generating three electron beams (7,8,9), a display screen (10) and deflection coils (11) for scanning the electron beams over the display screen. The electron gun includes a main lens part for focusing the electron beams on the display screen, the main lens part comprising main lens electrodes (26, 27) having apertures for passing of the electron beams, at least one of said main lens electrodes comprising two sub-electrodes (26*a*, 26*b*) adjacent to each other, each of the sub-electrodes having a central (311, 321) and two outer apertures (312, 322, 313, 323), whereby in operation between the adjacent sub-electrodes an astigmatic quadrupole field is generated. For the central apertures of the sub-electrodes it holds:

$$xQa \leqq xQb$$

and for the two outer apertures of the sub-electrodes it holds:

$$yQa \leqq yQb.$$

9 Claims, 3 Drawing Sheets

COLOR CATHODE RAY TUBE WITH SUBELECTRODES

BACKGROUND OF THE INVENTION

The invention relates to a color cathode ray tube device having an electron gun of the in-line type for generating three electron beams, a display screen and deflection means for scanning the electron beams over the display screen. The electron gun comprises a main lens part for focusing the electron beams on the display screen, the main lens part comprising main lens electrodes having apertures for passing of the electron beams, at least one of said main lens electrodes comprising at least two sub-electrodes adjacent to each other. Each of the sub-electrodes has a central and two outer apertures, whereby in operation between the adjacent sub-electrodes a quadrupole field is generated.

Such cathode ray tube devices are for instance used in television apparatuses and computer monitors.

A cathode ray tube device of the in the first paragraph mentioned type is known from U.S. Pat. No. 5,347,202. In such devices the main lens formed between the main lens electrodes focuses the electron beams on a display screen. The deflection means have an effect on the focusing of the electron beams, more specifically the electron beams are astigmatically focused as a function of the deflection angle. In order to counteract these effects a main lens electrode comprises two sub-electrodes between which a quadrupole field is generated between the apertures of the two sub-electrodes which quadrupole field counteracts, at least partly, the astigmatism caused by the deflection field.

Conventionally each sub-electrode comprises three substantially rectangular apertures, wherein one of the sub-electrode comprises three apertures elongated in the vertical direction and the other of the sub-electrodes comprises three apertures elongated in the horizontal direction, horizontal and vertical meaning parallel respectively perpendicular to the in-line plane, the in-line plane being the plane in which the three electron beams are situated.

Such electron guns are conventionally made by stacking the electrodes, including the sub-electrodes, on stacking pins whereafter the electrodes are interconnected. The accuracy wherewith the electrodes are stacked on the pins inter alia determines the accuracy with which the facing apertures of the two sub-electrodes are positioned with respect to each other and other electrodes in the electron gun, and therewith determines the average quality of the electron gun and thus of the color cathode ray tube device.

SUMMARY OF THE INVENTION

It is an object of the invention to improve the average quality of a electron gun as described in the opening paragraph.

According to the invention, a color cathode ray tube device of the type described in the opening paragraph is characterized in that for the central apertures of the sub-electrodes it holds:

$$xQa \leqq xQb$$

and for the two outer apertures of the sub-electrodes it holds:

$$yQa \leqq yQb$$

Herein:

xQa stands for the width of the aperture in the horizontal direction in the sub-electrode remote from the main lens, xQb stands for the width of the aperture in the horizontal direction in the sub-electrode adjacent to the main lens yQa stands for the height of the aperture in the vertical direction in the sub-electrode remote from the main lens and yQb stands for the height of the aperture in the vertical direction in the sub-electrode adjacent to the main lens.

The invention is based on the insight that, when using pins to stack the apertures upon, the cooperation between the central pin, and the central apertures, determine the accuracy with which the sub-electrodes are positioned with respect to each other in the x-(horizontal)-direction, whereas the outer pins and thus the outer apertures determine the accuracy with which the sub-electrodes are positioned with respect to each other in the y-(vertical)-direction. The x-dimension (width) of the central aperture of the sub-electrode adjacent to the main lens (=xQb) is greater than or equal to the same dimension for the central aperture of the sub-electrode remote from the main lens (=xQa). The y-dimension (height) of the outer apertures of the sub-electrode adjacent to the main lens (=yQb) is greater than or equal to the same dimension for the outer apertures in the electrode remote from the main lens (=yQa). Thereby the positions of the sub-electrodes relative to each other is accurately determinable in both the x- and y-direction. In the conventional electron gun in particular the relative position in the y-direction cannot be accurately determined.

Preferably it holds that $$xQa < xQb - 3\mu m \text{ for the central aperture}$$

and $$yQa < yQb - 3\mu m \text{ for the central apertures}$$

A difference between xQa and xQb and between yQa and yQb increases the accuracy with which the sub-electrodes are positioned with respect to each other, in respect to designs in which there is no difference (i.e. xQa=xQb);

Preferably the center and outer apertures differ in form. Although it is possible within the framework of the invention that all apertures of a sub-electrode have the same form, giving the apertures differing forms enables larger apertures to be used. Any misalignment of the apertures becomes less important as the size of the apertures increases, thus the accuracy with which the sub-electrodes are positioned with respect to each other is increased. Furthermore the quality of the dynamic lens formed between the sub-electrodes is increased because the effective apertures of the lens is increased.

The quadrupole field may be static, but preferably the color cathode ray tube device comprises means for supplying a dynamically varying control voltage to at least one of the sub-electrodes, whereby in operation dynamically varying quadrupole fields are obtained.

DETAILED DESCRIPTION OF THE PREFERRED EMBODIMENT

Figure 1:
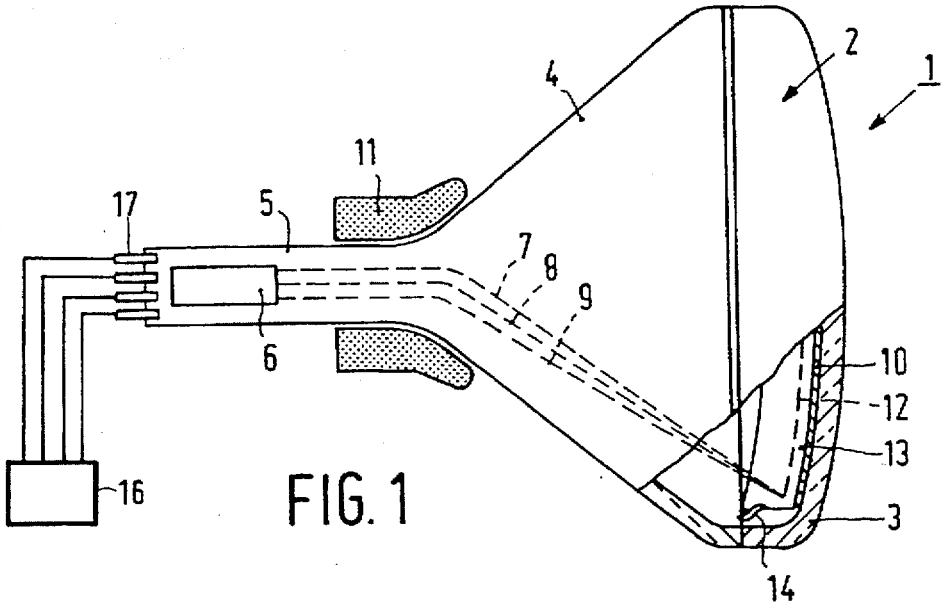
FIG. 1 is a longitudinal section of an electron gun according to the invention.

FIG. 1 shows a color display tube of the "in-line" type in a longitudinal section. In a glass envelope 1, which is composed of a display window 2 having a face plate 3, a cone 4 and a neck 5, this neck accommodates an integrated electron gun system 6 which generates three electron beams 7, 8 and 9 whose axes are located in the plane of the drawing. The axis of the central electron beam 8 initially coincides with the tube axis. The inside of the face plate 3 is provided with a large number of triplets of phosphor elements. The elements may consists of lines or dots. Each triplet comprises an element consisting of a blue green luminescing phosphor, an element consisting of a green luminescing phosphor and an element consisting of a red green luminescing phosphor. All triplets combined constitute the display screen 10. The three co-planar electron beams are deflected by deflection means, for instance by a system of deflection coils 11. Positioned in front of the display screen is the shadow mask 12 in which a large number of elongated apertures 13 is provided through which the electron beams 7, 8 and 9 pass, each impinging only on phosphor elements of one color. The shadow mask is suspended in the display window by means of suspension means 14. The device further comprises means 16 for supplying voltages to the electron gun system via feedthroughs 17.

Figure 2:
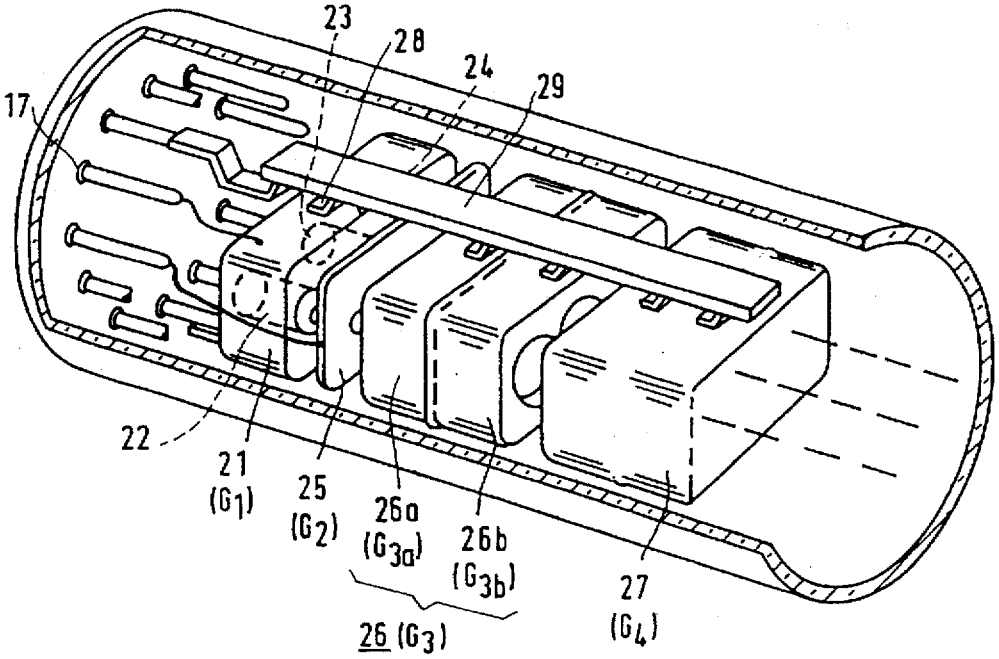
FIG. 2 is a perspective view of an electron gun as used in the color display tube of FIG. 1.

FIG. 2 is a perspective view on an electron gun as used in the display tube shown in FIG. 1.

The electron gun system 6 comprises a common control electrode 21, also referred to as the G1-electrode, in which three cathodes 22, 23 and 24 are secured. The electron gun system further comprises a common plate-shaped electrode 25, also referred to as the G2-electrode. The electron gun system further comprises a third common electrode 26, also referred to the G3-electrode, which electrode comprises two sub-electrode **26*a* and 26*b*** (also referred to as the G3*a* and G3*b*-electrode). The electron gun further comprises a final accelerating electrode 27, (also referred to as the G4-electrode). All electrodes are connected to a ceramic carrier 29 via braces 28. Only one of these carriers is shown in this figure. The neck of the envelope is provided with electrical feedthroughs 17, electrical connection between the feedthroughs and some of the electrodes are schematically shown in FIG. 2. The main lens is formed between sub-electrode **26*b* and final accelerating electrode 27. Due to the deflection fields there is a detrimental effect on the focusing of the electron beams, more specifically the electron beams are astigmatically focused as a function of the deflection angle. In order to counteract these effects a dynamically varying quadrupole field is generated between the sub-electrodes 26*a* and 26*b***. Between the facing apertures of the two sub-electrodes a field is generated which counteract, at least partly, the astigmatism caused by the deflection field.

Figure 3:
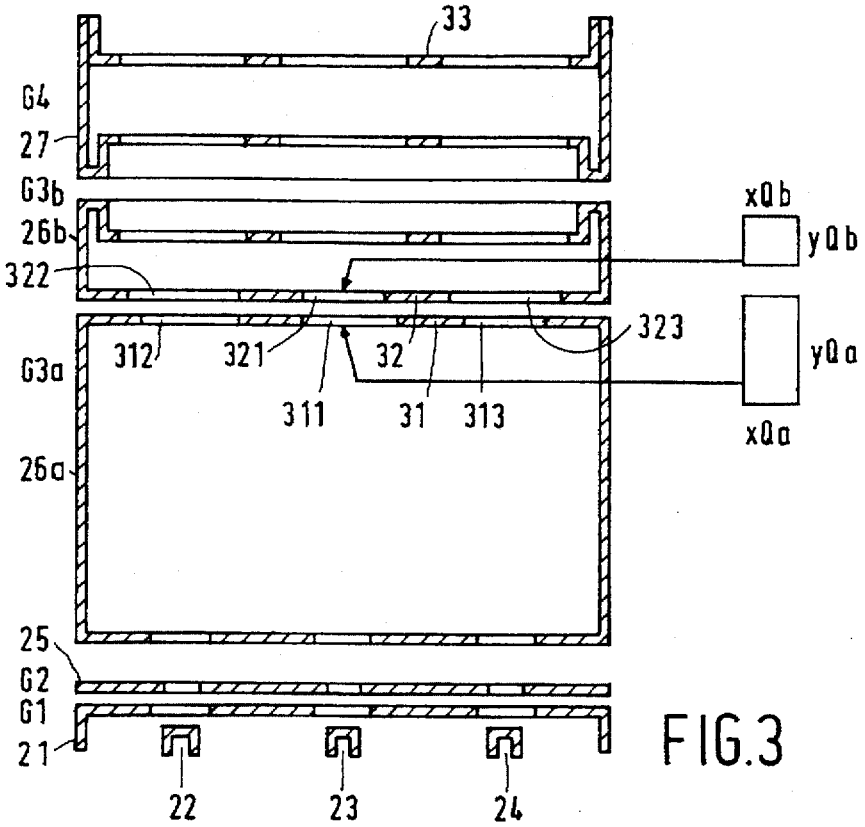
FIG. 3 is a longitudinal section through the electron gun shown in FIG. 2.

FIG. 3 is a longitudinal section through the electron gun shown in FIG. 2.

FIG. 3 shows the different electrodes and sub-electrodes in longitudinal section. The facing sides 31 and 32 of the sub-electrodes **26*a* and 26*b* each have three facing apertures (respectively 311, 312 and 313 for sub-electrode 26*a* and 321, 322 and 323 for sub-electrode 26*b* ). Also shown, schematically, are the shapes of the central apertures 311 and 321 in the two sub-electrodes 26*a* and 26*b*. The different dimension and the designations of these dimensions are also indicated; herein stands xQa for the width of an aperture in the horizontal direction in the sub-electrode 26*a*** remote from the main lens;

xQb for the width of an aperture in the horizontal direction in the sub-electrode **26*b*** adjacent to the main lens;

yQa for the height of an aperture in the vertical direction in the sub-electrode **26*a* remote from the main lens and yQb for the height of an aperture in the vertical direction in the sub-electrode 26*b*** adjacent to the main lens.

Electrode **26*b*** (G3*b*) also comprises three apertures in the side facing the electrode 27. Between these apertures and the corresponding apertures in electrode 27 (G4) in operation the main lens is formed.

Figure 4:
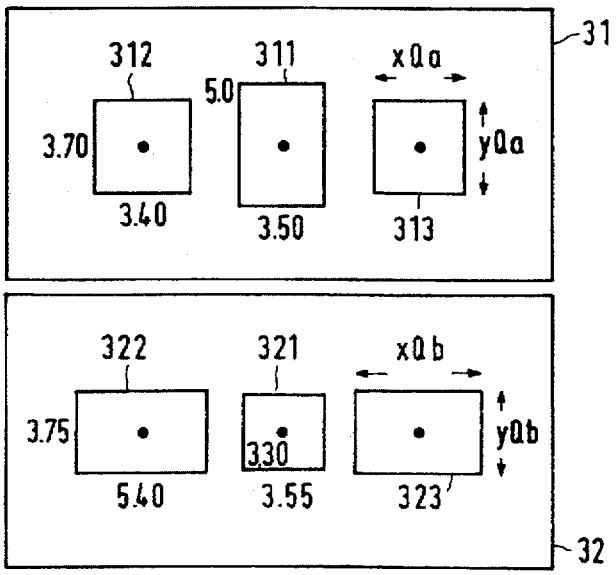
FIG. 4 is a elevational view on two sub-electrodes of the electron gun as shown in FIG. 3, FIGS. 5A to 5C illustrate the positions of the apertures in the two sub-electrodes with respect to each other.

FIG. 4 is a elevational view of two sub-electrodes of the electron gun as shown in FIG. 3. As an example the xQa and yQa of aperture 313 and xQb and yQb for aperture 323 are indicated. The numbers next to the apertures indicate the dimension of the apertures in mm.

FIG. 4 shows that for the central aperture (311 and 321) it holds:

$$xQa(311) \leqq xQb(321)(xQa=3.50mm, xQb=3.55mm)$$

and for the outer apertures (312, 313 and 322, 323) it holds $$yQa(312,313) \leqq yQb(322,323)(yQa=3.70mm,\ yQb=3.75mm)$$

Due to the fact that xQa≦xQb (for the central aperture) the sub-electrodes G3*a* and G3*b* are ,in the x-direction, accurately positioned with respect to each other. Due to the fact that yQa≦yQb (for the outer apertures) the sub-electrodes G3*a* and G3*b* are, in the y-direction, accurately positioned with respect to each other.

FIG. 3 also shows an insert 33 in final accelerating electrode 27 (G4). Provision of such an insert is preferred. By means of such an insert a small correcting quadrupole field can be generated within electrode G4 which, by means of choosing the right form and size of the apertures in such an insert can be used to correct a residual static astigmatism caused by the difference in aperture size and form between the central and outer apertures.

Figure 5A:
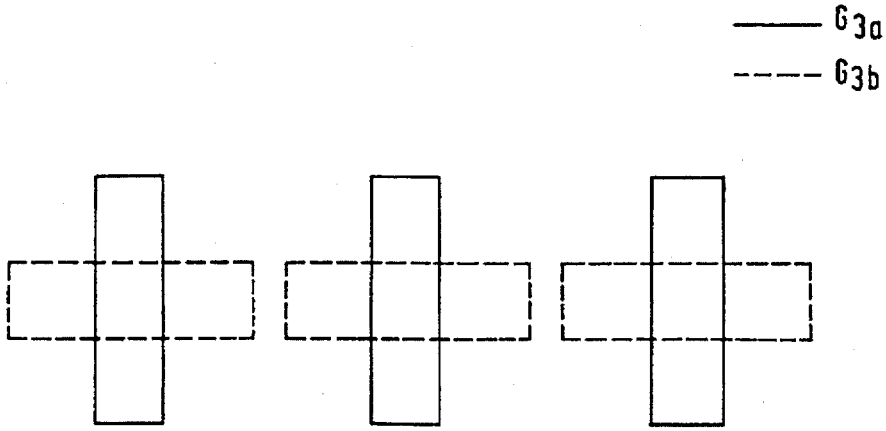
Figure 5B:
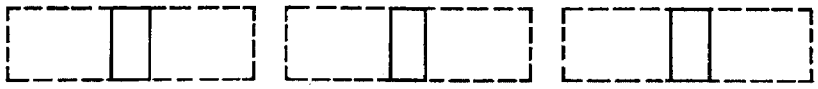
Figure 5C:
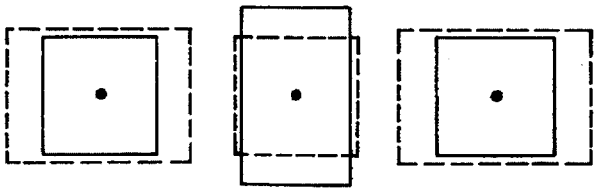

FIGS. 5A to 5C shows the positions of the apertures in the sub-electrodes G3*a* (full lines) and G3*b* (dotted lines) with respect to each other. FIG. 5A shows the conventional design. The sub-electrode G3*b* has three horizontally aligned rectangular apertures, sub-electrode G3*a* has three vertically aligned rectangular apertures of substantially the same form as the apertures in sub-electrode G3*b*. The sub-electrodes are normally, during manufacturing, stacked on pins where electrode G3*a* is stacked on top of electrode G3*b* on stacking pins. The dimension of the stacking pins in the vertical (y-)direction cannot be larger than the height of the apertures in G3*b*, since otherwise electrode G3*b* could not be stacked on the pins. This means that the position of electrode G3*a* in the y-direction cannot be accurately determined by means of stacking pins. FIG. 5B shows a design within the frame work of the invention in which the apertures in each plate are uniform. It is possible to accurately determine the positions of the G3*a* sub-electrode in the y-direction. The apertures in G3*a* as shown in FIG. 5B are relatively small, which is undesirable. FIG. 5C shows an embodiment (corresponding to the embodiment shown in FIG. 4) in which there is a difference in shape between the central and outer apertures. This embodiment enables larger apertures to be used which is advantageous, since larger apertures are easier to position in respect to each other and less prone to suffer from defects. Misalignments of the electrodes G3*a* and G3*b* as well as burrs or other irregularities on the edges of the apertures have less detrimental effects as the size of the apertures increase. Preferably the distance between the apertures 312 and 313 (measured between centers (points of symmetry) of said apertures) is substantially equal to the distance between the outer apertures in electrode G3*b* which form part of the main lens, i.e. the main lens pitch is substantially equal to the distance (pitch) between the outer apertures 312 and 313.

It will be clear that within the scope of the invention many variations are possible to those skilled in the art. For instance in the examples the sub-electrodes are comprised in electrode G3, they could however also be comprised in final accelerating electrode G4. Furthermore electron gun systems can be supplied with more electrodes between the main lens and the cathodes, in which case the numbering of the electrodes changes, and the sub-electrodes can include a G5 electrode (if two extra electrodes are placed between the cathodes and the main lens).

We claim:

1. Color cathode ray tube device having an electron gun of the in-line type for generating three electron beams, a display screen and deflection means for scanning the electron beams over the display screen, wherein the electron gun comprises a main lens part for focusing the electron beams on the display screen, said main lens part comprising main lens electrodes having apertures for passing of the electron beams, at least one of said main lens electrodes comprising at least two sub-electrodes adjacent to each other, each of the sub-electrodes having a central and two outer apertures, whereby in operation between the adjacent sub-electrodes a quadrupole field is generated, characterized in that for the central apertures of the sub-electrodes it holds:

$$xQa \leqq xQb$$

and for the two outer apertures of the sub-electrodes it holds:

$$yQa \leqq yQb$$

and additionally at least one of the following relationships (a) and (b) holds: (a) for the sub-electrode remote from the main lens. yQa for the outer apertures is less than yQa for the central aperture, and (b) for the sub-electrode adjacent to the main lens. xQb for the central aperture is less than xQb for the outer apertures, wherein:

xQa is the width of the aperture in the horizontal direction in the sub-electrode remote from the main lens, xQb is the width of the aperture in the horizontal direction in the sub-electrode adjacent to the main lens yQa is the height of the aperture in the vertical direction in the sub-electrode remote from the main lens and yQb is the height of the aperture in the vertical direction in the sub-electrode adjacent to the main lens.

2. A color cathode ray tube device as claimed in claim 1 wherein, for the central aperture $$xQa < xQb - 3\mu m$$

and, for the outer apertures, $$yQa < yQb - 3\mu m.$$

3. A color cathode ray tube device as claimed in claim 1 wherein the central and outer apertures of each of the sub-electrodes differ in shape.

4. A color cathode ray tube as claimed in claim 1 wherein at least one of the main lens electrodes comprises a correction element.

5. Color cathode ray device as in claim 1 wherein both relationships (a) and (b) hold.

6. Color cathode ray tube device having an electron gun of the in-line type for generating three electron beams, a display screen and deflection means for scanning the electron beams over the display screen, wherein the electron gun comprises a main lens part for focusing the electron beams on the display screen, said main lens part comprising main lens electrodes having apertures for passing of the electron beams, at least one of said main lens electrodes comprising at least two sub-electrodes adjacent to each other, each of the sub-electrodes having a central and two outer apertures, wherein the apertures are sized and arranged so that, in operation, the apertures of the adjacent sub-electrodes independently generate therebetween an astigmatic quadrupole field, characterized in that for the central apertures of the sub-electrodes it holds:

$$xQa \leqq xQb$$

and for the two outer apertures of the sub-electrodes it holds:

$$yQa \leqq yQb$$

wherein:

xQa is the width of the aperture in the horizontal direction in the sub-electrode remote from the main lens, xQb is the width of the aperture in the horizontal direction in the sub-electrode adjacent to the main lens yQa is the height of the aperture in the vertical direction in the sub-electrode remote from the main lens and yQb is the height of the aperture in the vertical direction in the sub-electrode adjacent to the main lens.

7. A color cathode ray tube device as claimed in claim 6 wherein, for the central aperture $$xQa < xQb - 3\mu m$$

and, for the outer apertures, $$yQa < yQb - 3\mu m.$$

8. A color cathode ray tube device as in claim 6 wherein the central and outer apertures of at least one of the sub-electrodes differ from each other in shape.

9. A color cathode ray tube device as in claim 8 wherein the central and outer apertures of both of the sub-electrodes differ from each other in shape.

* * * * *